United States Patent [19]

Polster

[11] 3,994,136

[45] Nov. 30, 1976

[54] HOT GAS ENGINE

[75] Inventor: Norman E. Polster, Argenta, Canada

[73] Assignee: Josam Manufacturing Co., Michigan City, Ind. ; a part interest

[22] Filed: July 3, 1975

[21] Appl. No.: 593,162

[52] U.S. Cl. ..... 60/518; 60/525

[51] Int. Cl.[2] ..... F02G 1/06

[58] Field of Search ..... 60/518, 525

[56] References Cited

UNITED STATES PATENTS

| | | | |
|---|---|---|---|
| 3,315,465 | 4/1967 | Wallis | 60/518 |
| 3,416,308 | 12/1968 | Livezey | 60/518 |
| 3,482,457 | 12/1969 | Wallis | 60/518 X |

*Primary Examiner*—Allen M. Ostrager

*Attorney, Agent, or Firm*—Philip D. Golrick

[57] ABSTRACT

A multi-cylinder self-starting hot gas engine according to the present invention consists of two parallel pairs of opposed displacer cylinders with respective displacer members mounted for movement therein and two parallel pairs of opposed work cylinders disposed parallel to the displacer cylinders and having respective pistons arranged to reciprocate therein; each work cylinder communicating with a respective displacer cylinder to provide a cold end chamber. First transmission connects the displacers for synchronized movement offset in phase within the cylinders and a second transmission interconnects the pistons for synchronized movement offset in phase within the cylinders. An output drive is connected to the pistons. An adjustable phase displacer interconnects the first and second transmission means for adjusting the phase relation of the displacers with respect to their associated pistons from an in-phase condition in which no torque is applied to or from the output drive to an optimum-phase displacement position in which the maximum torque is applied to or from the output drive. A fluid heat source enclosure completely surrounds displacer cylinder hot end chambers to put the gaseous medium in an intimate heat transfer relationship with the heating fluid so that when the engine is at rest with the displacers in the in-phase condition, movement of the displacers, in response to operation of the adjustable phase displacer away from the in-phase condition causes an immediate imbalance in pressure applied to the pistons to provide an immediate self-start. Cooling means is provided at the cold end for cooling the gaseous medium therein.

20 Claims, 12 Drawing Figures

HOT GAS ENGINE

FIELD OF INVENTION

This invention relates to hot gas engines. In particular, this invention relates to a multi-cylinder hot gas engine which is self-starting.

PRIOR ART

Multi-cylinder hot gas engines of the type operating on the Stirling cycle have been known for many years. Such hot gas engines have not, however, been self-starting and have, therefore, required a starting mechanism and a mechanism for releasing the engine from its work load.

In the initial stages of the development of the hot gas engine, it was common practice to apply heat directly to the "hot end" of an operating gas space. These early engines were generally single cylinder engines and lacked a self-starting characteristic. In more recent multi-cylinder engines, in an attempt to obtain the maximum output power, the hot end has been heated by a plurality of small pipes extending outwardly from the hot end into a heat source such as a combustion tube or the like. Again, however, these engines were not self-starting.

Variations in the power output of hot gas engines has been achieved by adjusting the phase relationship of the work pistons to the "expellers" or displacers as described in U.S. Pat. No. 2,465,139 Van Weenen et al. However, this phase displacement does not in fact contribute a self-starting characteristic to the hot gas engines though such utility is asserted. A further adaptation of this system is described in U.S. Pat. No. 3,538,706, dated Nov. 10, 1970, Toepel, and again the structure does not provide a self-starting engine.

SUMMARY OF INVENTION

The present invention overcomes the difficulties of the prior art described above and provides a self-starting hot gas engine adapted to operate with a gaseous working fluid which comprises at least three cylinders, at least three displacers mounted for movement within the respective cylinders, each between a first position spaced a substantial distance from the hot end of its cylinder to admit gaseous medium to a hot end chamber formed therebetween and a second position more closely adjacent said end of its cylinder to displace gaseous medium from the hot end chamber, at least three pistons arranged to reciprocate each in a working cylinder space communicating with a respective one of said cylinders, each piston being associated with a displacer to define a cold end space therebetween, said pistons being movable in the working cylinder spaces between a first position minimizing said cold end space and a second position in which the cold end space may be a maximum volume, first transmission means interconnecting the displacers for synchronized movement within the cylinders with equal successive phase differences or offsets, second transmission means interconnecting the pistons for synchronized movement within the working cylinder spaces with equal successive phase differences or offsets, equal to those of the displacers, adjustable phase displacer means interconnecting the first and second transmission means for adjusting the phase relation of the displacers with respect to their associated pistons from an in-phase condition in which no torque is applied to or from the pistons to an optimum-phase displacement position in which the maximum force is applied to the pistons, output drive means drivingly connected to the pistons and a heat source enclosure completely surrounding each hot end chamber whereby all the gaseous medium in each hot end chamber is located in an intimate heat transfer relationship with a heating fluid such that when the engine is at rest with the displacers in said in-phase condition, movement of the displacers, in response to operation of the adjustable phase displacer means away from the in-phase condition, causes an immediate imbalance in pressure applied to the pistons to provide an immediate self-start, and cooling means at the cold end for cooling the gaseous medium therein.

PREFERRED EMBODIMENT

The invention will be more clearly understood after reference to the following detailed specification read in conjunction with the drawings wherein FIG. 1 is a pictorial illustration of a hot gas engine according to the present invention;

Figures 4, 5, 7, 8:
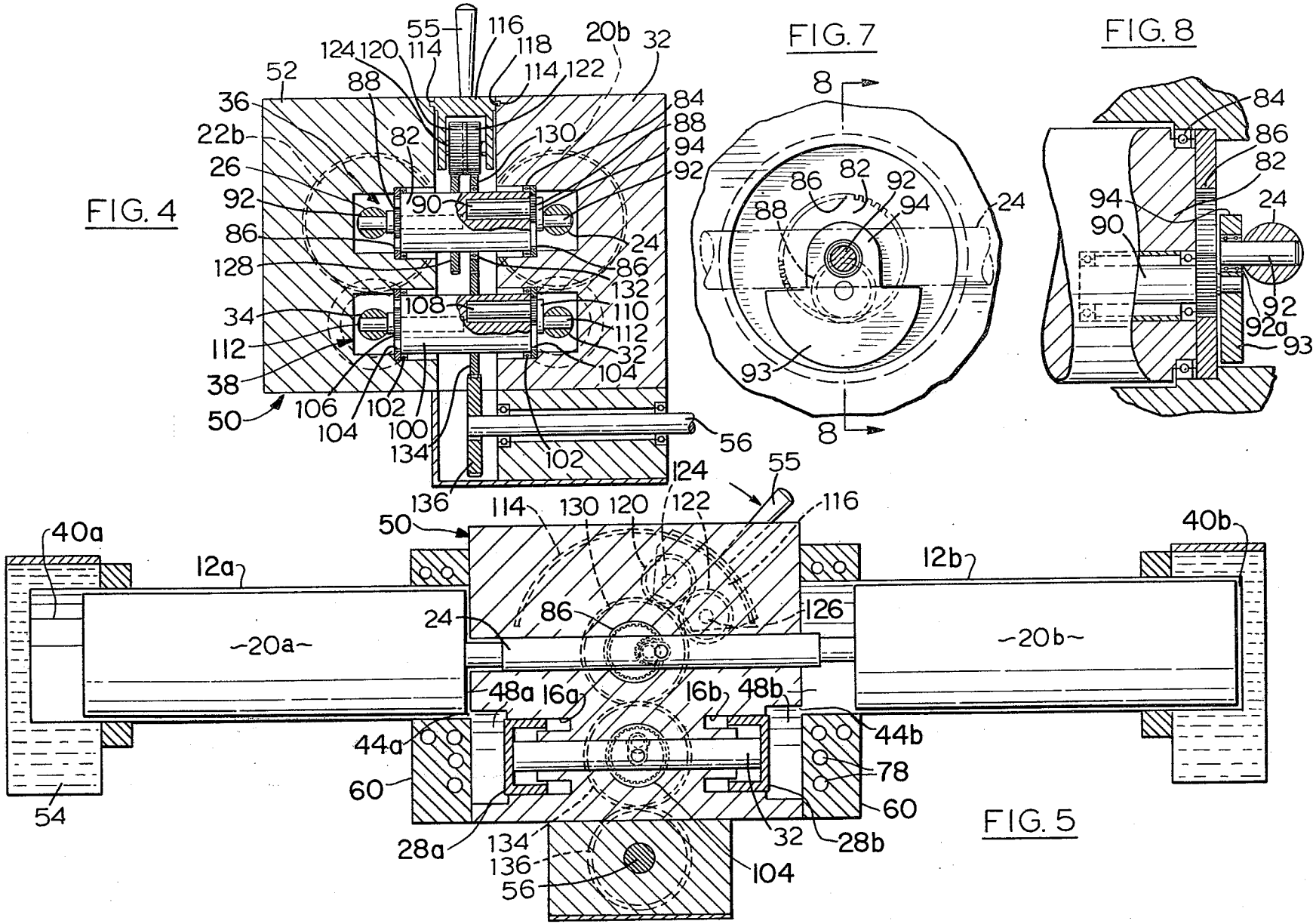
FIG. 4 is a section along the line 4—4 of FIG. 2.
FIG. 5 is a sectional view similar to FIG. 2 showing the phase displacer mechanism in the optimum-phase displacement.

FIGS. 6*a*, 6*b*, 6*c*, 6*d* and 6*e* are diagrammatic representations of the relative positions of the displacers and pistons for various positions in the operating cycle of the engine;

FIG. 7 is an end view of a displacer transmission shaft incorporating means according to a further embodiment of the invention; and FIG. 8 is a section view in the direction of the arrow 8—8 of FIG. 7.

GENERAL ORGANIZATION

Figure 1:
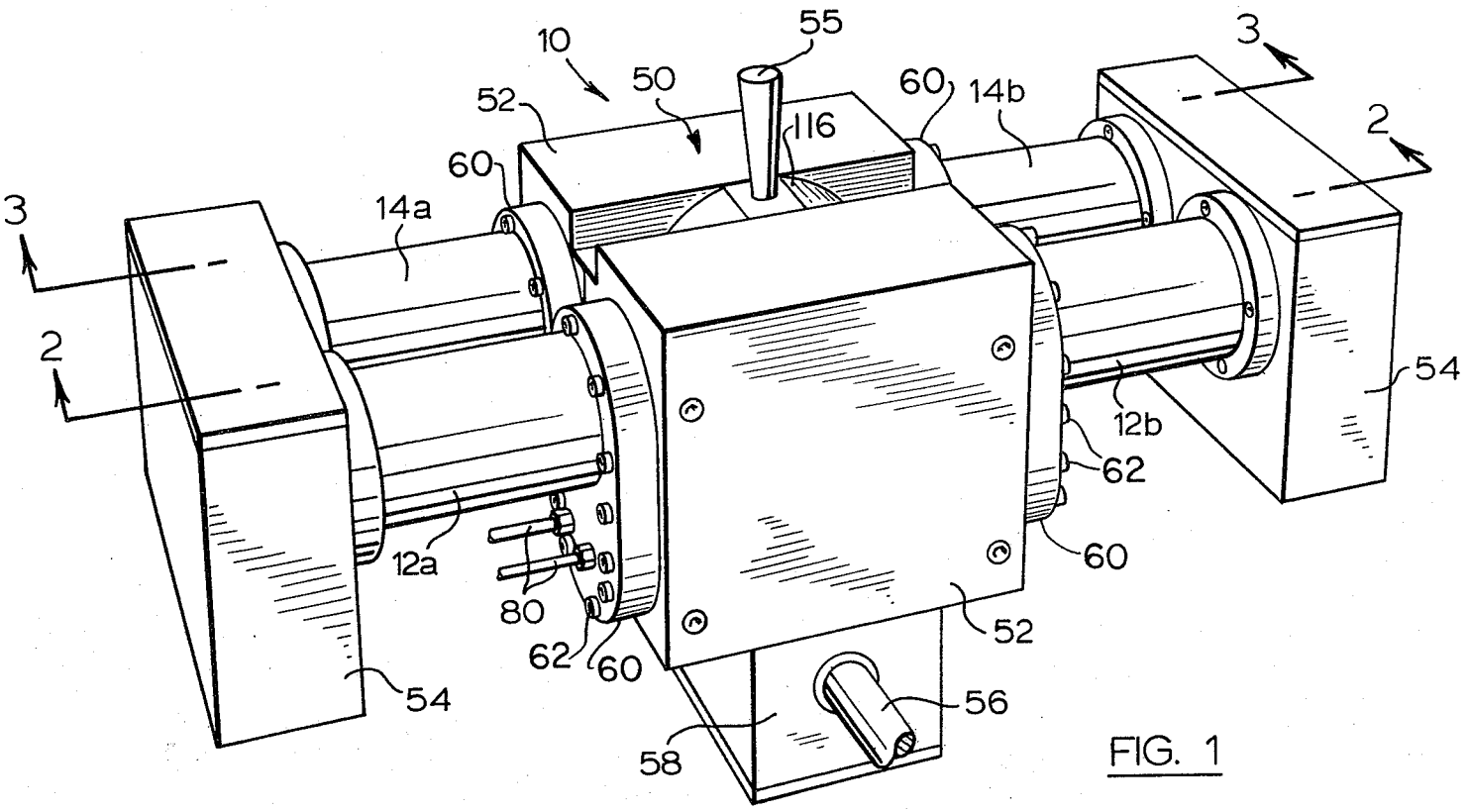

With reference to FIG. 1 of the drawings, the reference numeral 10 refers generally to a hot gas engine constructed in accordance with an embodiment of the present invention.

Figure 6A:
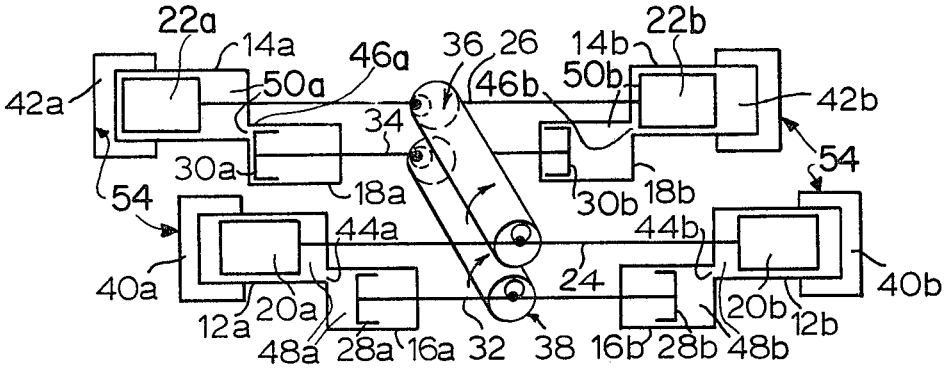
Figure 6B:
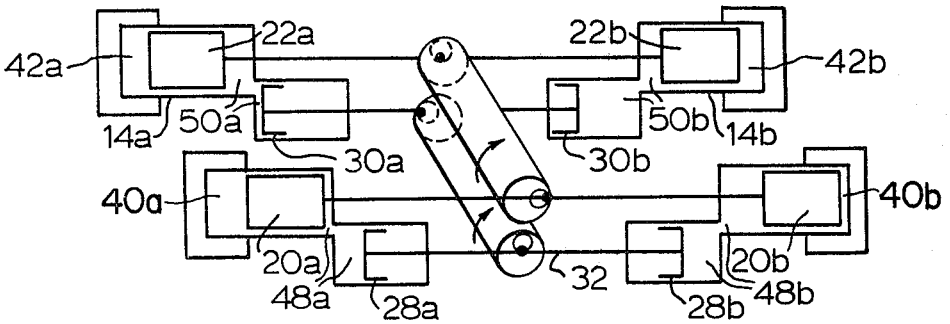

The detailed description of the working model illustrated in FIGS. 1 through 5 of the drawings will be more clearly understood following a preliminary consideration of the invention with reference to FIGS. 6*a* of the drawings which diagrammatically illustrates with various components in the simplified form. With reference to FIG. 6*a* of the drawings, it will be seen that the engine of the preferred embodiment has a total of eight cylinders. The cylinders 12*a*, 12*b* and 14*a*, 14*b* are displacer cylinders. The cylinders 16*a*, 16*b* and 18*a*, 18*b* are work cylinders. Displacer members 20*a*, 20*b*, 22*a* and 22*b* are mounted for movement within cylinders 12*a*, 12*b*, 14*a*, 14*b* respectively. The displacers 20*a* and 20*b* are connected to one another by displacer connector shaft 24 and displacers 22*a* and 22*b* are connected to one another by means of displacer connector shaft 26. Displacers 20*a* and 20*b* and their associated cylinders 12*a* and 12*b* are axially aligned with one another as are displacers 22*a* and 22*b* and their associated cylinders 14*a* and 14*b*.

Pistons 28*a*, 28*b* and 30*a*, 30*b* are slidably mounted in cylinders 16*a*, 16*b*, 18*a*, 18*b* respectively. Pistons 28*a*, 28*b* are connected to one another by means of connecting rod 32 and pistons 30*a*, 30*b* are connected to one another by means of connecting rod 34. Pistons 28*a* and 28*b* are axially aligned with respect to one another as are pistons 30*a*, 30*b*. The displacer connector shafts 24 and 26 are connected to one another by means of a first transmission means generally identified by the reference numeral 36 and the connecting rods 32 and 34 are connected to one another by means of a second transmission means generally identified by the reference numeral 38.

Each of the displacer cylinders 12*a*, 12*b*, 14*a*, 14*b* has a hot end which is the space, 40*a*, 40*b*, 42*a*, 42*b*, respectively between the outer end of the displacer and the outer end of the displacer cylinder when the displacer cylinder is in its innermost position. In order to achieve a maximum heat transfer to the hot end, the outer ends of the parallel displacer cylinders, 12*a* and 14*a*, 12*b* and 14*b*, respectively are mounted in heat enclosures 54, 54, such that the heat source fluid containing source enclosures completely surround the hot end chamber whereby the gaseous medium in each hot end chamber is located in an intimate heat transfer relationship with the heating fluid.

The displacement cylinder 12*a* is connected to the cylinder 16*a* by means of a passage 44*a*. Passage 44*b* similarly connects cylinders 12*b*, 16*b* and passages 46*a*, 46*b* connect cylinders 14*a*, 18*a* and 14*b*, 18*b* respectively. The space hereinafter referred to as the cold space or cold end is the space identified by the reference numeral 48*a*, 48*b*, 50*a*, 50*b* and is the space formed between the displacer members and their associated pistons. This space extends within both the displacer cylinders and work cylinders.

STRUCTURE OF ENGINE BLOCK, PISTONS, DISPLACERS & CYLINDERS

Referring now to FIG. 1 of the drawings, the reference numeral 10 refers generally to a model of a self-starting hot gas engine according to an embodiment of the present invention. The engine includes a housing or engine block 50 which consists of two half sections 52 which are connected to one another. A phase displacer handle 55 projects upwardly from the housing 50 centrally of the length thereof and is movable in an arc as will be described hereinafter. The displacer cylinders 12*a*, 12*b*, 14*a*, 14*b* are also clearly illustrated in FIG. 1 as are the heat sources, that is, the enclosures containing the heating fluid, which are commonly identified by the reference numeral 54. An output drive shaft 56 projects outwardly from a power output housing 58 mounted on the underside of the engine block 50.

Figure 2:
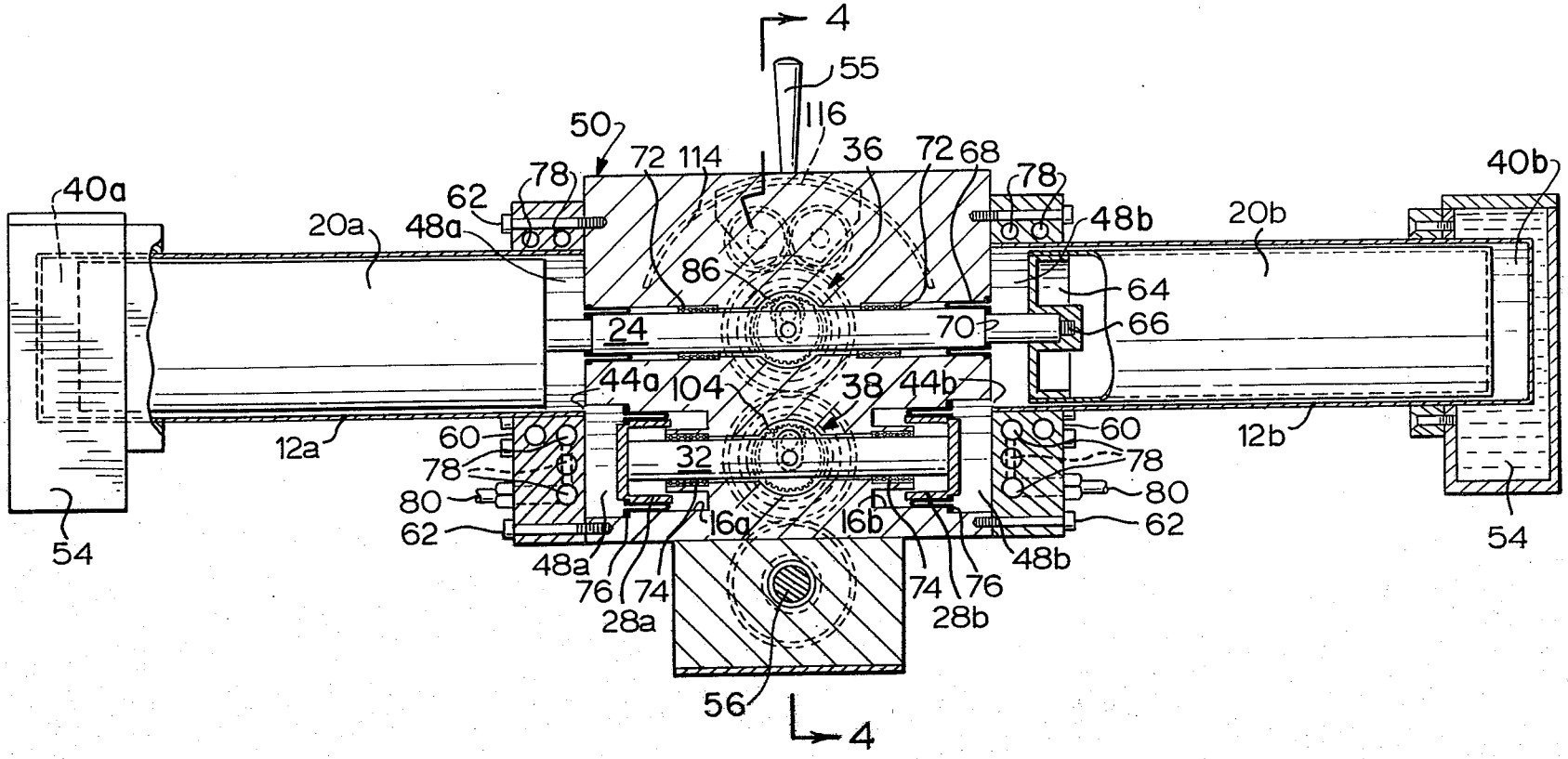
FIG. 2 is a section along the line 2—2 of FIG. 1.

The structural details of the apparatus will be more clearly seen with reference to FIG. 2 of the drawings.

As shown in FIG. 2 of the drawings, the displacer cylinders 12*a*, 12*b* are in the form of thin wall tubular members which are closed at their outer end and open at their inner end. Preferably the displacer cylinders are made from stainless steel having a wall thickness of about 0.025 inches. The stainless steel affords strength at the temperatures involved enabling use of a thin wall for a short thermal path with good radial heat transfer despite the relatively poor thermal conductivity of stainless steel; while yet impeding longitudiinal transfer by virtue of the small area of that transfer path section and the low thermal conductivity. The inner ends of the cylinders 12*a*, 12*b*, 14*a*, 14*b* are mounted in end plates 60, as by welding or the like, which are bolted by means of bolts 62 to opposite side faces of the engine block 50.

The displacer members 20*a*, 20*b* are also thin wall tubular members closed at their outer end and having an end closure boss 64 at their inner ends. The displacer connecting shaft 24 has a threaded end portion 66 threadably mounted in the boss 64 to connect the oppositely disposed displacer members. A flexible rolling seal member 68 has one end located in a recess in the outer face of the side walls of the engine block 50 and the outer end mounted on shoulder 70 of the displacer connecting rod 24. The connecting rod 24 is slidably mounted in ball bearings 72 for reciprocating movement with respect to the engine block 50.

Pistons 28*a*, 28*b* are threadably connected to connecting rod 32 which are slidably mounted in the housing 50 by ball bearings 74. Rolling seal members 76 are connecting to pistons 28*a*, 28*b* and the adjacent wall of the housing so as to seal the cold ends 48*a*, 48*b*. In order to effect cooling of the cold ends 48*a*, 48*b*, cooling passages 78 are formed in the end closure walls 60 and cooling fluid is circulated through the passages 78 by means of conduit 80.

TRANSMISSION MEANS, OUTPUT GEARING

Figure 3:
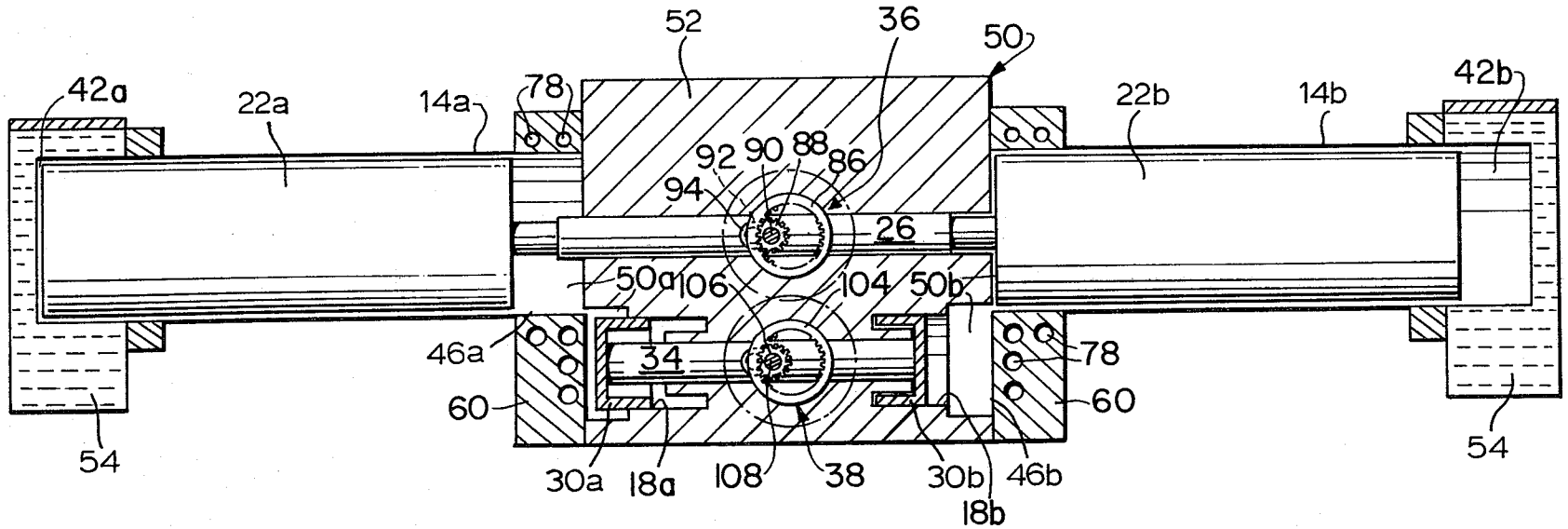
FIG. 3 is a section along the line 3—3 of FIG. 1.

The first and second transmission means 36 and 38 are illustrated in FIGS. 3 and 4 of the drawings. The first transmission means 36 includes a displacer transmission shaft 82 mounted for rotation in bearings 84. Hypocycloid ring gears 86 are mounted fast within the engine block sections 52 at opposite ends of and coaxially of the shaft 82. A hypocycloid planetary gear 88 is located at each end of the shaft 82 and is meshed with each ring gear 86. The planetary gear 88 is mounted on a shaft 90 which is mounted for rotation within the transmission shaft 82 eccentrically of the longitudinal axis of the transmission shaft 82. A crank pin 92 is mounted on the end of a crank member 94 which is secured with respect to the planetary gear 88. As shown in FIG. 8, the crank pin may have rotatable support by a bearing 92*a* in arm 94. The crank pin 92 is mounted in the transverse plane of the axis of rotation of the transmission shaft 82 for translating movement in response to rotation of the planetary gear about the ring gear, that is, with an orbital motion about the axis of shaft 82. The crank pin 92 is mounted within a passage extending through the displacer shafts 24 such that the displacer connecting shafts 24 are reciprocably driven in response to rotation of the transmission shaft 82.

The second transmission means 38 is identical to the first transmission means and includes a piston transmission shaft 100 mounted for rotation in bearings 102, ring gears 104, planetary gears 106, planetary gear support shafts 108, crank arms 110 and crank pins 112. The crank pins 112 connect connecting rods 32 and 34.

PHASE DISPLACER

An important feature of the apparatus of the present invention is the provision of adjustable phase displacer means for adjusting the phase relation of the displacers with respect to their associated pistons between an in-phase condition and an optimum-phase displacement position which is generally about 90° removed from the in-phase position in a four-cylinder apparatus such as that of the embodiments illustrated in the drawings.

Arcuate-shaped slots 114 are formed on opposite faces of the central passage formed between the engine block units 52. The center of rotation of the arcuate-shaped slots 114 is located at the axis of rotation of the displacer transmission shaft 82. A slide member 116 has arcuate-shaped rails 118 on opposite faces thereof slidably mounted in arcuate-shaped slots 114 so that movement of the handle 55 in at least a 45° arc in opposite directions from a central position, shown in FIG. 2 of the drawings, is available. The slide member 116 has a U-shaped recess on the inner face thereof within which gears 120 are 122 are mounted. The gears 120 and 122 are mounted for rotation about shafts 124, 126 carried by the slide member 116. The gears 120 and 122 are meshed with respect to one another. A gear member 128 is rigidly secured with respect to the first transmission shaft 82 and meshed with gear 120 of the slide member 116. A gear member 130 is mounted for rotation relative to the transmission shaft 82 by means of a bearing 132. A gear member 134 is rigidly mounted on the second transmission shaft 100 and is meshed with the gear 130. The gear 130 is meshed with the gear 122 carried by the slide member 116. The gear member 134 is meshed with an output transmission gear 136 which is mounted on the output shaft 56.

In order to adjust the phase relation of the displacers with respect to their associated pistons, it is only necessary to move the lever arm 55. Movement of the lever arm 55 from the position shown in FIG. 2 of the drawings to the position shown in FIG. 5 of the drawings effects a 45° angular movement of the lever arm which results in a 90° phase displacement of the displacers with respect to the pistons. Movement of the lever arm 55 moves the slide member 116. By reason of the fact that the output shaft 56 is coupled directly to a work load, this shaft and its associated gear 136 is not movable in response of movement of the lever arm 55. On the other hand the force required to move the displacer is quite low as it is only necessary to overcome gas friction and the inertia and friction of the translating and rotating members.

As a result, the gear 134 carried by the piston transmission shaft will not move nor will the gear 130 carried by the displacer transmission shaft 82. As a result, movement of the slide 116 will cause the gear 122 to rotate about gear 130. The rotation of the gear 122 will drive the gear 120 which will in turn drive the gear 128 which is secured to the displacer transmission shaft 82. As a result of the movement of the displacer shaft 82, the displacer transmission shaft will be moved by the transmission means from the position shown in FIG. 2 of the drawings to the position shown in FIG. 5. This effects a movement of the displacers relative to their associated pistons between an in-phase condition and a 90° out-of-phase condition. It will be noted that the lever arm 55 may be moved to any position to adjust the phase displacement as required when the output shaft is stationary or when rotating in either direction.

When the apparatus is in use with the phase adjustment lever 55 in the upright position shown in FIG. 2 of the drawings, the displacers and their associated pistons are in the relative positions shown in FIG. 6*a* of the drawings with the engine at rest. In this position, as previously indicated, the displacers are located in an inphase position with respect to their associated pistons. With reference to the relative positions of the pistons 28*a*, 28*b*, and their associated displacers 20*a*, 20*b*, it will be noted that the volume of the hot end and cold end on each side of the transmission means 38 is identical so that equal pressure will be applied to pistons 16*a*, 16*b* so that there will be no movement of pistons 16*a*, 16*b*. With respect to the pistons 30*a* and 30*b* and displacers 22*a*, 22*b*, it will be noted that in FIG. 6*a* these displacers and pistons are located at the extreme end of their stroke and no pressure can be applied to the piston 30*a* which would cause movement of the pistons 30*a* away from its position illustrated in FIG. 6*a*.

An immediate self-starting of the engine is effected by moving the lever arm 55 from the vertical position to the position shown in FIG. 5 of the drawings. As a result of this action, the displacer members will be moved while the pistons remain stationary. Movement of the displacer member 20*a* away from its position shown in FIG. 6*a* to its position shown in FIG. 6*b* will result in the displacement of a substantial volume of gaseous medium from the cold end 48*a* to the hot end 40*a*. This gaseous medium will be immediately placed in an intimate heat transfer relationship with the heating fluid to the heat source which encloses the hot end, resulting in the rapid heating of a substantial volume of gaseous medium which will cause an increase in pressure in the hot end which will be translated to an increase in pressure in the cold end 48*a*. Simultaneously the hot medium which was previously located in the hot end 40*b* of the oppositely disposed displacer cylinder 12*b* will be transferred to the cold end 48*b* and will be rapidly cooled.

Figure 6C:
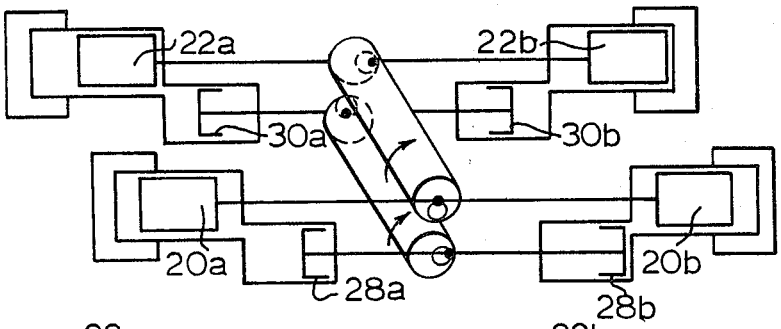
Figure 6D:
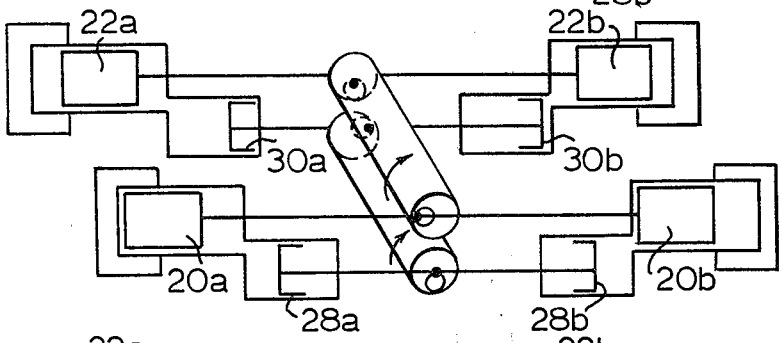
Figure 6E:
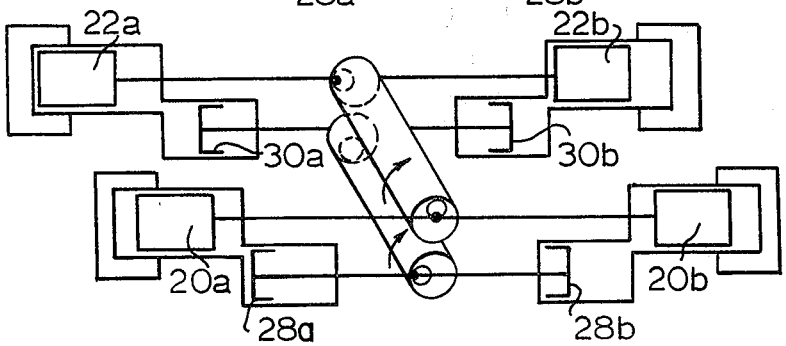

The pressure differential established by this action will cause the piston 28*a* to move to the right to assume the position shown in FIG. 6*c* of the drawings. A similar pressure differential will be established between the cold ends and hot ends of the other pistons resulting from the movement of the displacers caused by the movement of the displacer adjustment lever 55. It follows that movement of the displacer adjustment lever 55 from the in-phase position to the optimum out-of-phase position results in an immediate self-starting of the engine.

By reason of the fact that the apparatus is a multi-cylinder apparatus with a set of four working pistons 90° out of phase with respect to one another that is, having within the set like phase offsets or differences of 90° when the instantaneous piston positions are considered successively in the order at which each say starts its power stroke during a complete engine cycle, therefore, the torque applied at any point during the operating cycle is substantially uniform. This relation among the connected pistons as a set and the corresponding relation among the displacers is termed an "offset" or "phase offset". Similarly the four displacers as a set have equal phase differences of 90° or a phase offset of 90°. Consequently, when the phase displacer is adjusted to the optimum-phase displacement position which, as previously indicated, is about a 90° phase displacement of displacers with respect to pistons, a full torque is applied to the piston transmission shaft so that full torque is available at the output shaft. Similarly, when the phase adjustment arm 55 is moved to the in-phase position, the engine will be in a neutral position in which there is no exchange of energy. It is this characteristic which permits the engine to be coupled directly to the power output shaft without the use of a clutch member.

It will also be noted that movement of the displacer adjustment lever in an arc 45° opposite to the movement shown between positions illustrated in FIGS. 2 and 5 of the drawings will result in a reversal of the direction of rotation of the output shaft and this characteristic may be used to advantage in providing braking of the power output shaft. It will be understood that when the engine is driving the load with the phase displacement required to provide a driving torque the transfer of energy is a conversion of heat to mechanical energy and when the phase displacement is reversed to effect a braking of the engine the energy conversion is from a mechanical energy to heat energy. As a result of the regenerative effect of the braking, hat is returned to the heat storage when, for example, a vehicle is being braked by the reversal of phase displacement.

FIGS. 7–8 BALANCING

For simplicity of illustration some of the features relating to the balance have been eliminated from the drawings previously described. FIGS. 7 and 8 of the drawings serve to illustrate the manner in which the center of the mass of the translating bodies are balanced about the axis of rotation of the transmission shaft. It will be understood that the shaft illustrated in FIGS. 7 and 8 may be the displacer shaft 82 or the piston transmission shaft 100.

As will be readily apparent from the drawings, the center of mass of the translating displacers and connecting rods will be located at the center of the crank pin 92. In order to balance this mass, there is provided a weight 93 as an integral part of the crank arm 94. The weight segment 93 and the crank pin 92 rotate about the axis of rotation of the planetary gear 88 and serve to balance one another. The entire rotating assembly, including the planetary gear, rotates about the axis of the shaft 82 and this mass is also to be balanced. This mass may be balanced by the mass of the material of the shaft which is removed in drilling out the shaft to receive the shafts 90 on which the planetary gears 88 are rotatably mounted as shown in FIG. 4 of the drawings. Alternatively, additional mass may be applied to the shaft (not shown) diametrically opposite the axis of the shafts 90 on which the planetary gears 88 are located.

By the same mechanism as described above, the center of mass of the pistons may be balanced about the axis of rotation of the piston transmission means.

As previously indicated various modifications of the present invention will be apparent to those skilled in the art. Hot gas engines wherein the displacers and pistons are mounted in common cylinders are known and it will be apparent that the phase adjustment mechanism of the present invention may be adapted for use in these engines. It will also be apparent that the phase adjustment mechanism of the present invention may be used in a hot gas engine of a type which does not employ the horizontally opposed relationship of pistons and displacers.

From the aforegoing it will be apparent that the present invention provides a self-starting hot gas engine which is of simple construction and which is capable of providing up to and including full torque at any position of the output shaft under all load conditions and may be dynamically balanced without great difficulty.

By providing a mechanism which permits adjustment of the phase relation of the displacers with respect to the pistons, it is possible to deliver energy to the load, take energy from the load or to locate the engine in neutral position in which a substantially no energy transfer takes place. It is also possible to effect a self-starting in either direction and to utilize a reversal of the phase displacement as a braking force applied to the load which has the effect of converting the mechanical energy back to heat energy. The phase displacement is also operable to adjust the speed of operation of the engine. The phase adjustment characteristic of the engine provides an instantaneous continuously controllable accelerating or decelerating torque, including zero torque for any shaft position, any shaft speed and direction including a stationary condition. These and other advantages of the present invention will be apparent to those skilled in the art.

What I claim as my invention is:

1. A self-starting hot gas engine adapted to operate with a gaseous working fluid comprising, a. a plurality of at least three displacer cylinder spaces, b. a set of displacers each mounted for movement within a respective said cylinder space between a first position spaced a substantial distance from one cylinder space end to form a hot end chamber therebetween for admission of a gaseous working medium and a second position more closely adjacent said end of its cylinder space to displace gaseous medium from the hot end chamber, c. a like plurality of at least three piston cylinder spaces, each communicating with a respective one of the said displacer cylinder spaces, d. a set of pistons with each piston arranged to reciprocate in a respective said piston cylinder space, whereby each piston is associated with a displacer to define a cold end space therebetween, each said piston being movable between a first position minimizing said cold end space and a second position in which the cold end space may be a maximum volume, e. first transmission means connected to and interconnecting said displacers for synchronized reciprocating movement with equal phase offsets in the displacer set, f. second transmission means connected to and interconnecting said pistons for synchronized reciprocating movement with equal phase offsets within the piston set, the offsets of the piston set being equal to the offsets of the displacer set, g. output drive means drivingly connected through said second transmission means to said pistons, h. adjustable phase displacer means interconnecting said first and second transmission means for adjusting the phase relation of the displacers with respect to their associated pistons from an in-phase condition in which no torque is applied to or from output drive means to an optimum-phase displacement position in which the maximum torque is applied to or from the output drive means, i. a heat source at each hot end chamber whereby all the gaseous medium in each hot end chamber is located in an high heat transfer relationship with a heating fluid such that when the engine is at rest with said displacers in said in-phase condition, movement of the displacers, in response to operation of said adjustable phase displacer means away from said in-phase condition, causes an immediate imbalance in pressure applied to said pistons to provide an immediate self-start, j. cooling means at each said cold end space for cooling the gaseous medium therein.

2. A self-starting engine as claimed in claim 1 having a. four displacer cylinder spaces and respective displacers arranged in oppositely disposed aligned pairs, b. four work cylinder spaces and respective pistons arranged in oppositely disposed aligned pairs, and c. passage means communicating between each displacer cylinder space and a respective work cylinder space at the cold end of the displacer cylinder.

3. A self-starting gas engine is claimed in claim 1 wherein said heat source enclosure is a heat pipe of a heat storage unit.

4. A self-starting gas engine as claimed in claim 3 wherein each hot end chamber has an outer stainless steel wall separating it from said heat source enclosure, said stainless steel wall having a thickness of about .025 inches.

5. A self-starting hot gas engine as claimed in claim 2 including displacer connector shaft means connecting the oppositely disposed aligned displacer members in pairs and connecting rod means connecting the oppositely disposed aligned pistons in pairs.

6. A hot gas engine as claimed in claim 5 wherein said first transmission means interconnects each of said displacer shafts for movement of one pair of displacers offset in phase with respect to the other pair of displacers.

7. A self-starting hot gas engine as claimed in claim 6 wherein said first transmission means comprises a. a displacer transmission shaft mounted for rotation in a housing of the engine and extending transversely between and normal to said displacer connector shafts, b. a hypocycloid ring gear mounted fast within said housing at each end of said displacer transmission shaft, c. A hypocycloid planetary gear mounted at each end of said displacer transmission shaft and meshed with said ring gear for orbiting rotation about the axis of displacer transmission shaft, the gear ratio of the ring gear to planetary gear being 2 to 1, d. means interconnecting each said planetary gear and the adjacent displacer connector shaft to effect reciprocating movement of said connector shafts and their associated displacers in response to rotation of said displacer transmission shaft, e. one of said planetary gears being 90° out of phase with the other planetary gear to provide movement with phase offset of one pair of displacers with respect to the other

8. A self-starting hot gas engine as claimed in claim 7 wherein said second transmission means interconnects said connecting rods for movement with phase offset of one pair of pistons with respect to the other pair of pistons.

9. A hot gas engine as claimed in claim 8 wherein said second transmission means comprises a. a piston transmission shaft mounted for rotation in said housing and extending transversely between and normal to said connecting rod means, b. a hypocycloid ring gear mounted fast within said housing at each end of said piston transmission shaft, c. a hypocycloid planetary gear mounted at each end of said piston transmission shaft and meshed with the last said ring gear for orbiting rotation about the axis of said piston transmission shaft, the gear ratio of the last said ring gear to the last said planetary gear being 2 to 1, d. respective means interconnecting each last said planetary gear and adjacent connecting rod means to effect reciprocating movement of said connecting rod means and their associated pistons in response to rotation of said piston transmission shaft, e. one of the last said planetary gears being 90° out of phase with respect to the other to provide piston movement with one pair of pistons offset 90° in phase with respect to the other.

10. A hot gas engine as claimed in claim 9 wherein said phase displacer means for adjusting the phase relation of the displacers with respect to their associated pistons comprises a. a first gear member mounted on and rigidly secured with respect to said displacer transmission shaft, b. a second gear member mounted on said displacer transmission shaft for rotation thereabout, c. a third gear member mounted on and rigidly secured with respect to said piston transmission shaft, said third gear member being meshed with said second gear member, d. a phase displacer member mounted in said housing for movement in an arc about the axis of rotation of said displacer transmission shaft, e. fourth and fifth gear members meshed one with the other and mounted for rotation on said phase displacer member, said fourth gear member being meshed with said first gear member and said fifth gear member being meshed with said second gear member whereby angular movement of said phase displacer member about said axis of rotation of the displacer transmission shaft causes movement of the displacers relative to the pistons, and whereby adjustment of the phase relation of the displacers with respect to their associated pistons between an in-phase position in which the pistons are not producing torque and an optimum phase displacement in which maximum output torque is produced by the pistons.

11. A self-starting hot gas engine as claimed in claim 9 wherein each of said planetary gears is weighted to be balanced for rotation about its axis of rotation with respect to its associated transmission shaft.

12. A self-starting hot gas engine as claimed in claim 11 wherein the centre of mass of the displacers and the displacer-associated transmission means rotates about the axis of said displacer-associated transmission shaft in use, said displacer transmission means being adapted to dynamically balance the resultant of the mass of the displacers-associated and displacer transmission means about the axis of the displacer transmission shaft.

13. A self-starting gas engine as claimed in claim 12 wherein the centre of mass of the pistons and the piston-associated transmission means rotates about the axis of the piston transmission shaft, said piston-associated transmission means being adapted to dynamically balance the resultant of the mass of the pistons and piston transmission means about the axis of the piston-associated transmission shaft.

14. A self-starting hot gas engine adapted to operate with a gaseous working medium comprising a. a housing;

b. four displacer cylinders associated with the housing and arranged in oppositely disposed aligned pairs;

c. displacers mounted to reciprocate in respective displacer cylinders for movement within said cylinders each between a first position spaced a substantial distance from one end of its cylinder to admit gaseous medium to a hot end chamber formed therebetween and a second position more closely adjacent said end of its cylinder to displace gaseous medium from said hot end chamber;

d. displacer connector shaft means slidably mounted in said housing and connecting the oppositely disposed aligned displacers in pairs;

e. first transmission means interconnecting each of said displacer shafts for 90° phase displaced movement of one pair of displacers with respect to the other pair of displacers comprising i. a displacer transmission shaft mounted for rotation in said housing and extending transversely between and normal to said displacer connector shafts, ii. a hypocycloid ring gear mounted fast within said housing at each end of said displacer transmission shaft, iii. a hypocycloid planetary gear mounted at each end of said displacer transmission shaft and meshed with the respective said ring gear orbiting rotation about the axis of said displacer transmission shaft, the gear ratio of the ring gear to planetary gear being 2 to 1, and iv. respective means interconnecting each said planetary gear and the adjacent displacer connector shaft to effect reciprocating movement of said connector shafts and their associated displacers in response to rotation of said displacer transmission shaft, v. one of said planetary gears being 90° out of phase with the other planetary gear to provide said 90° phase displaced movement of one pair of displacers with respect to the other;

f. four work cylinders associated with said housing and arranged in oppositely disposed aligned pairs;

g. passage means communicating between each displacer cylinder and one end of a respective work cylinder;

h. a respective piston slidably mounted in each work cylinder and defining a cold end space between the other end of a respective said displacer and said one end of the work cylinder including said passage means, said pistons being movable with respect to said work cylinders between a first position to minimize the volume of said cold end space and a second position in which the cold end space may be a maximum volume;

i. connecting rod means slidably mounted in said housing and connecting the oppositely disposed aligned pistons in pairs;

j. second transmission means interconnecting said connecting rods for 90° phase displaced movement of one pair of pistons with respect to the other comprising i. a piston transmission shaft mounted for rotation in said housing and extending transversely between and normal to said connecting rod means, ii. a hypocycloid ring gear mounted fast within said housing at each end of said piston transmission shaft, iii. a hypocycloid planetary gear mounted at each end of said piston transmission shaft and meshed with the respective said ring gear for orbiting rotation about the axis of said piston transmission shaft, the gear ratio of the ring gear to planetary gear being 2 to 1, and iv. respective means interconnecting each last said planetary gear and the adjacent connecting rod means to effect reciprocating movement of said connecting rod means and their associated pistons in response to rotation of said piston transmission shaft or rotary movement of the piston transmission shaft in response to reciprocating movement of the connecting rod means, v. one of the last said planetary gears being 90° out of phase with the other planetary gear to provide said 90° phase displaced movement of one pair of pistons with respect to the other;

k. output drive means drivingly connected to said piston transmission shaft;

l. adjustable phase displacer means for adjusting the phase relation of the displacers with respect to their associated pistons comprising i. first gear member mounted on and rigidly secured with respect to said displacer transmission shaft, ii. a second gear mounted on said displacer transmission shaft for rotation thereabout, iii. a third gear member mounted on and rigidly secured with respect to said piston transmission shaft, said third gear member being meshed with said second gear member, iv. a phase displacer member mounted in said housing for movement in an arc about the axis of rotation of said displacer transmission shaft, v. fourth and fifth gear members meshed one with the other and mounted for rotation on said phase displacer member, said fourth gear member being meshed with said first gear member and said fifth gear member being meshed with said second gear member whereby angular movement of said phase displacer member about said axis of rotation of the displacer transmission shaft causes movement of the displacers relative to the pistons there by adjusting the phase relation of the displacers with respect to their associated pistons between an in-phase position in which no torque is applied by or to the pistons and an optimum-phase displaced relation in which maximum torque is applied by or to the pistons m. a heat source enclosure completely surrounding each hot end chamber whereby all the gaseous medium in each hot end chamber is located in an intimate heat transfer relationship with a heating fluid such that when the engine is at rest with the displacers in said in-phase condition, movement of the displacers in response to operation of said adjustable phase displacer means away from said in-phase condition, causes an immediate imbalance in pressure applied to said pistons to provide an immediate self-start; and n. cooling means at each said cold end space for cooling the gaseous medium therein.

15. A hot gas engine adapted to operate with a gaseous working medium comprising A. a housing;

B. a displacer cylinder space associated with the housing;

C. a displacer mounted to reciprocate in the displacer cylinder space between a first position spaced a substantial distance from one cylinder space end to form a hot end chamber therebetween for admission of the gaseous medium and a second position more closely adjacent said end of the cylinder space to displace gaseous medium from said hot end chamber;

D. a displacer connector shaft connected endwise to said displacer to project out of the displacer cylinder space and slidably mounted relative to said housing;

E. a work cylinder space associated with said housing and communicating with the other end of said displacer cylinder space;

F. a piston slidably mounted in the work cylinder space and defining a cold end space between the other end of said displacer and the work cylinder, said piston being movable with respect to said work cylinder between a first position to minimize the volume of said cold end space and a second position in which the cold end space may be a maximum volume;

G. a piston connecting rod connected endwise to said piston to project out of the work cylinder space and slidably mounted in said housing;

H. first transmission means associated with said displacer shaft comprising i. a displacer transmission shaft mounted for rotation in said housing and extending normal to said displacer connector shaft, ii. a hypocycloid ring gear mounted fast within said housing at an end of said displacer transmission shaft, iii. a hypocycloid planetary gear rotatably mounted at said end of the displacer transmission shaft and meshed with the ring gear for orbiting rotation about the axis of said displacer transmission shaft, the gear ratio of the ring gear to planetary gear being 2 to 1, and iv. means interconnecting said planetary gear and the displacer connector shaft to effect reciprocating movement of said connector shaft and displacer in response to rotation of said displacer transmission shaft;

I. second transmission means associated with said piston connecting rod comprising i. a piston transmission shaft mounted for rotation in said housing and extending normal to said connecting rod, ii. a hypocycloid ring gear mounted fast within said housing at an end of said piston transmission shaft.

iii. a hypocycloid planetary gear rotatably mounted at said end of the piston transmission shaft and meshed with the last said ring gear for obtaining rotation about the axis of said piston transmission shaft, the gear ratio of the last said ring and planetary gears being 2 to 1, and iv. means interconnecting the last said planetary gear and the connecting rod to effect reciprocating movement of said connecting rod and its associated piston in response to rotation of said piston transmission shaft or rotary movement of the piston transmission shaft in response to reciprocating movement of the connecting rod and its associated piston;

J. output drive means drivingly connected to said piston transmission shaft;

K. gearing means interconnecting said transmission shafts;

L. a heat source enclosure completely surrounding said hot end chamber whereby all the gaseous medium in the hot end chamber is located in an intimate heat transfer relationship with a heating fluid; and M. cooling means at the cold end space for cooling the gaseous medium therein.

16. A hot gas engine as described in Claim 15, including adjustable phase displacer means for adjusting the phase relation of the displacer with respect to the associated piston; said adjustable phase displacer means providing the said gearing means interconnecting the transmission shafts and comprising i. a first gear member mounted on and rigidly secured with respect to said displacer transmission shaft, ii. a second gear member mounted on said displacer transmission shaft for rotation thereabout, iii. a third gear member mounted on and rigidly secured with respect to said piston transmission shaft, said third gear member being meshed with said second gear member, iv. a phase displacer member mounted in said housing for movement in an arc about the axis of rotation of said displacer transmission shaft, v. fourth and fifth gear members meshed one with the other and mounted for rotation on said phase displacer member, and said fifth gear member being meshed with said second gear member whereby angular movement of said phase displacer member about said axis of rotation of the displacer transmission shaft causes movement of the displacer relative to the piston thereby adjusting the phase relation of the displacer with respect to the associated piston between an in-phase position in which no net torque over one cycle is applied by or to the piston and an optimum-phase displacer relation in which maximum net torque over one cycle is applied by the piston.

17. A hot gas engine as described in claim 15, wherein said displacer cylinder space and said work cylinder space are disposed in offset parallel relation and communicate through a passage between the other end of the displacer cylinder space and the work cylinder space; and the axes of said transmission shafts are parallel to each other.

18. A hot gas engine as described in claim 15, including a second displacer cylinder space in opposed coaxial alignment with the first displacer space and a respective displacer therein;

a second work cylinder space communicating with the second displacer cylinder space and being in opposed coaxial alignment with the first work cylinder space and a respective piston therein;

said connecting shaft and said connecting rod being connected respectively between said displacers and between said pistons whereby a second said hot end chamber and a second said cold end space are defined, and the pistons move in the work cylinder spaces with 180° phase offset, and the displacers move in the displacer cylinder spaces with 180° phase offset with respect to each other.

19. A hot gas engine as described in claim 18, wherein each said displacer cylinder space and the respectively associated said work cylinder space are disposed in offset parallel relation and communicate through a passage between the other end of the displacer cylinder space and the work cylinder space; and the axes of said transmission shafts are parallel to each other.

20. A self-starting gas engine hot gas engine as described in claim 1, wherein each displacer cylinder space and its respective piston cylinder space are offset from coaxial disposition.

* * * * *